US007092663B2

(12) United States Patent
Takahashi et al.

(10) Patent No.: US 7,092,663 B2
(45) Date of Patent: Aug. 15, 2006

(54) IMAGE FORMING APPARATUS AND IMAGE FORMING METHOD

(75) Inventors: Kouki Takahashi, Higashiyamato (JP); Ritsuo Fujii, Hachioji (JP); Hirotaka Kabashima, Tachikawa (JP); Hiroshi Isokawa, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 65 days.

(21) Appl. No.: 10/995,170

(22) Filed: Nov. 24, 2004

(65) Prior Publication Data

US 2005/0260016 A1 Nov. 24, 2005

(30) Foreign Application Priority Data

May 21, 2004 (JP) ..... 2004-151381

(51) Int. Cl.
*G03G 15/16* (2006.01)

(52) U.S. Cl. ..... 399/316; 399/388

(58) Field of Classification Search ..... 399/121, 399/124, 311, 312, 314, 316, 317, 388
See application file for complete search history.

(56) References Cited

U.S. PATENT DOCUMENTS 5,761,596 A * 6/1998 Osbourne et al. ..... 399/316
6,556,805 B1 * 4/2003 Kuo et al. ..... 399/316
6,766,138 B1 * 7/2004 Bonacci et al. ..... 399/316

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

An image forming apparatus, including:
an image carrier;
a transfer device for transferring toner images carried on the image carrier onto the recording material; and
a pressing section for pressing the transfer material onto the image carrier;
wherein the pressing section is trapezoidal, including:
a straight edge portion positioned at the center of the pressing section, perpendicular to the feeding direction of the recording material, and
sloped edge portions,
wherein the width of the straight edge portion is equal to or greater than 95% of the width of the recording material.

6 Claims, 6 Drawing Sheets

FIG. 6 ( a )
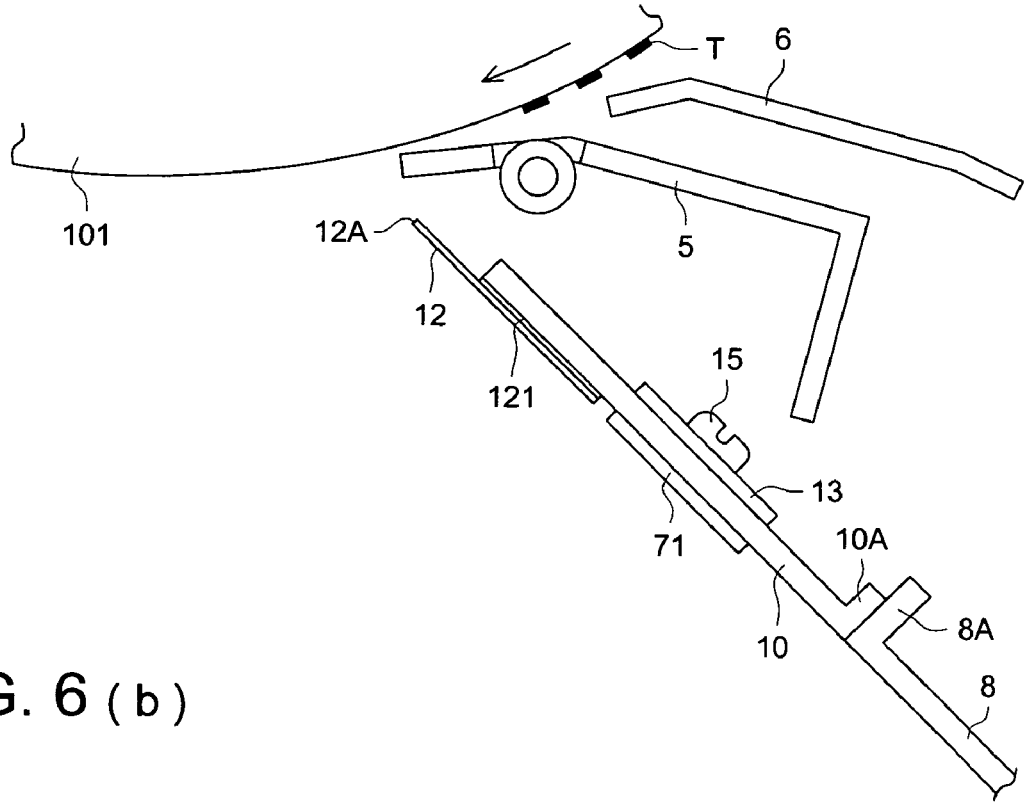
FIG. 6 ( b )
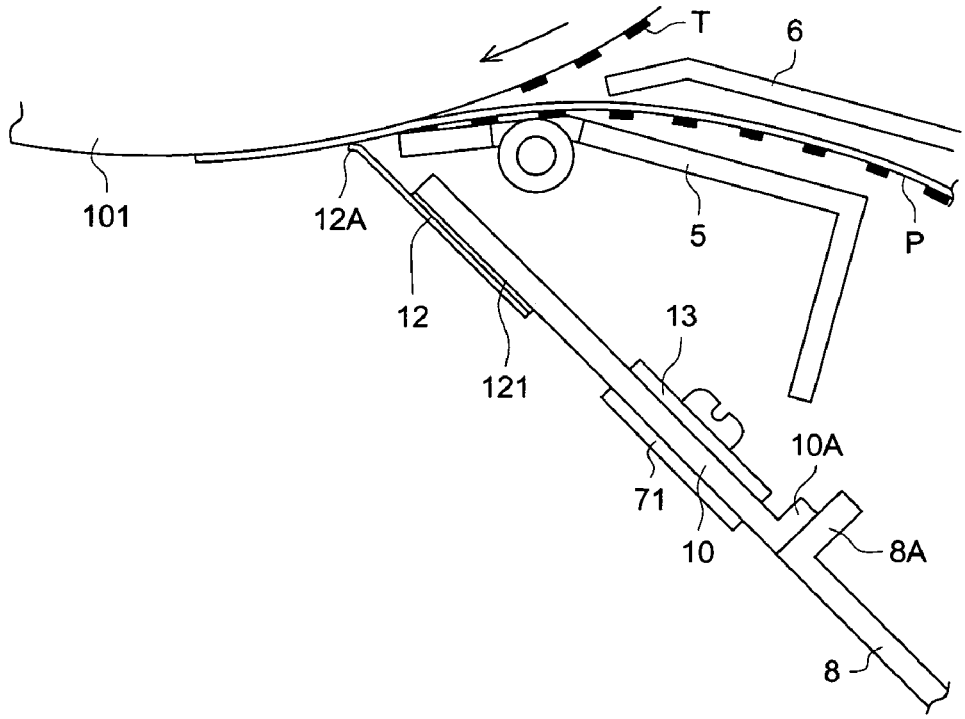

IMAGE FORMING APPARATUS AND IMAGE FORMING METHOD

BACKGROUND OF THE INVENTION

The present invention relates to an image forming apparatus employing an electro-photographic method, and in particular, to the technology for transferring toner images carried on an image carrier to a recording material.

Concerning a transfer device for transferring a toner image on an image carrier, such as a photoconductor or an intermediate transfer body, widely used is a technology wherein while the recording material is brought into contact with the image carrier, an electro-charging is conducted onto the recording material from its rear surface using an opposite polarity to the charged electricity of the toner forming the images, whereby the toner images are transferred onto the recording material by electrostatic force.

In order to improve the contact of the recording material to the image carrier, a pressing means is proposed in which the recording material is pressed onto the image carrier (see Patent Documents 1 and 2).

[Patent Document 1] U.S. Pat. No. 4,947,214

[Patent Document 2] U.S. Pat. No. 5,923,921

The transfer device described in Patent Documents 1 and 2 makes it possible to evenly contact the total surface of recording material onto the image carrier, and to prevent any clearance between the image carrier and the transfer material, and thereby the transfer device can evenly transfer images and can form images of high quality. However the inventor of the present invention found the problem of the transfer device in Patent Documents 1 and 2, which will be explained referring to FIGS. 1 and 2.

The pressing means, being elastic plate X made of a PET (polyethylene terephthalate) film, presses recording sheet P employing straight edge X1 positioned perpendicularly to feeding direction V of recording material P, and thereby the pressing means presses recording sheet P onto image carrier Z. In this case, the width of straight edge X1 is nearly equal to the width of recording material P, as shown in FIG. 1(*a*).

However, recording material P does not always run precisely on the specific conveyance path, but occasionally meanders. Accordingly the edge of elastic plate X cannot directly contact image carrier Z, which causes deterioration of the surface of the image carrier, resulting in lowered image quality.

In order to overcome this problem, the inventor tried to shorten width W1 of straight edge X1 less than width W2 of recording material P, shown in FIG. 1(*b*).

However, the inventor found unevenness of images of a white clearness, which is also known as toner repelling, at areas U (which are hatched areas) of recording material P which were not pressed by elastic plate X.

This phenomenon will be explained below.

Referring to FIG. 2, in order to improve contact between recording material P and image carrier Z, the edge of elastic plate X is positioned at the position nearest to the transfer area, where is within the discharging area of transfer device TR.

Accordingly, recording material is influenced by elastic plate X. However, since elastic material X does not contact area U, shown in FIG. 1(*b*), it cannot affect those.

Primarily, the transfer condition is set to be optimum at the image transfer area, that is, the transfer condition is set to be optimum considering the influence of elastic material X. Therefore at areas U, being the edges of the image, unstable transfer is performed under less than the optimal conditions, resulting in images with white clearness, which is due to toner having been repelled.

SUMMARY OF THE INVENTION

The object of the present invention is to overcome the above drawback.

The object of the present invention will be attained by the structures described below.

[Structure 1]

An image forming apparatus including:

an image carrier;

a transfer device for charging the back surface of a recording material in contact with the image carrier, and transferring toner images carried on the image carrier onto the recording material; and a pressing means for pressing the transfer material onto the image carrier;

wherein the pressing means includes an elastic plate whose top portion is formed to be a trapezoid, including:

a straight edge portion positioned at the center of the pressing means, perpendicular to a feeding direction of the recording material, and slope edge portions positioned at both ends of the straight edge portion, wherein the width of the straight edge portion is equal to or greater than 95% of the width of the recording material.

[Structure 2]

An image forming apparatus including:

an image carrier;

a transfer device for charging the back surface of the recording material contacting the image carrier, and transferring toner images carried on the image carrier onto the recording material; and a pressing means for pressing the transfer material onto the image carrier;

wherein the pressing means includes an elastic plate whose top portion is formed to be a trapezoid, including:

a straight edge portion positioned at the center of the pressing means, perpendicular to the feeding direction of the recording material;

sloped edge portions at both ends of the straight edge portion; and intermediate portions between the sloped edge portions and the straight edge portion;

wherein the intermediate portions are formed to be curved at curvature radius of greater than 5 mm.

BRIEF DESCRIPTION OF THE DRAWINGS

FIGS. 6(*a*) and (*b*) show the operation of the pressing device.

DETAILED DESCRIPTION OF THE PREFERRED EMBODIMENTS

Figure 1:
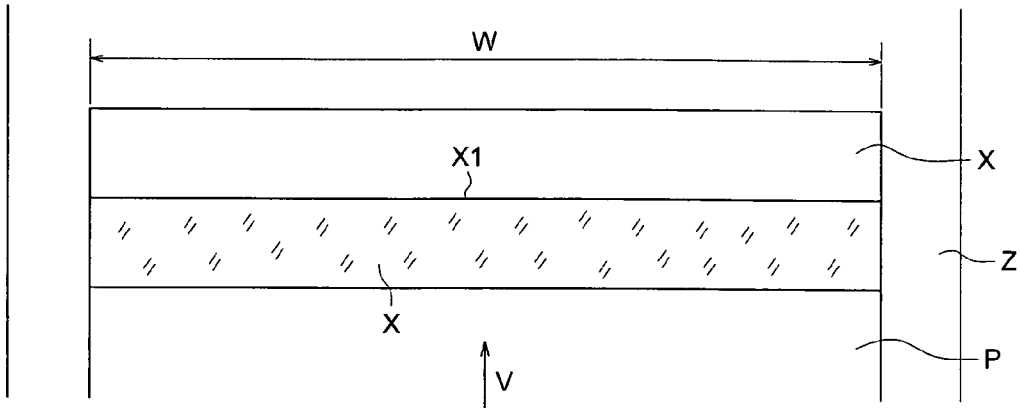
FIGS. 1(*a*) and (*b*) show the relation ship between the pressing means and the recording material.
Figure 1:
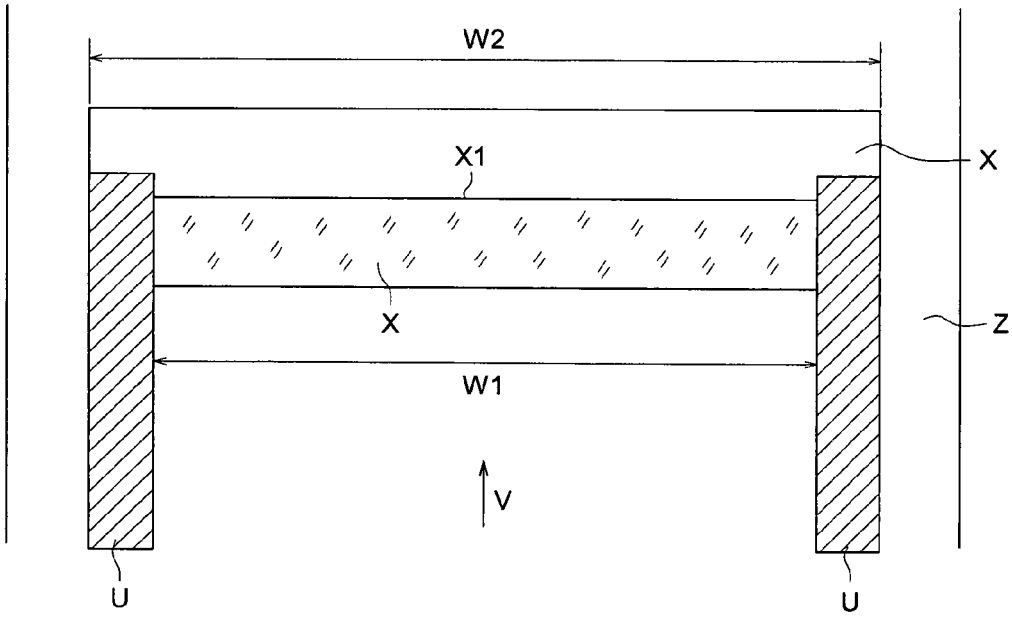
Figure 2:
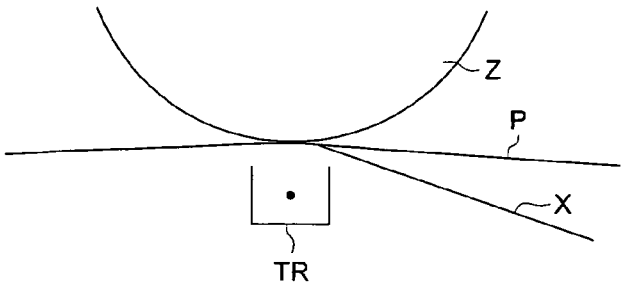
FIG. 2 shows the image carrier, recording material and the pressing material.
Figure 3:
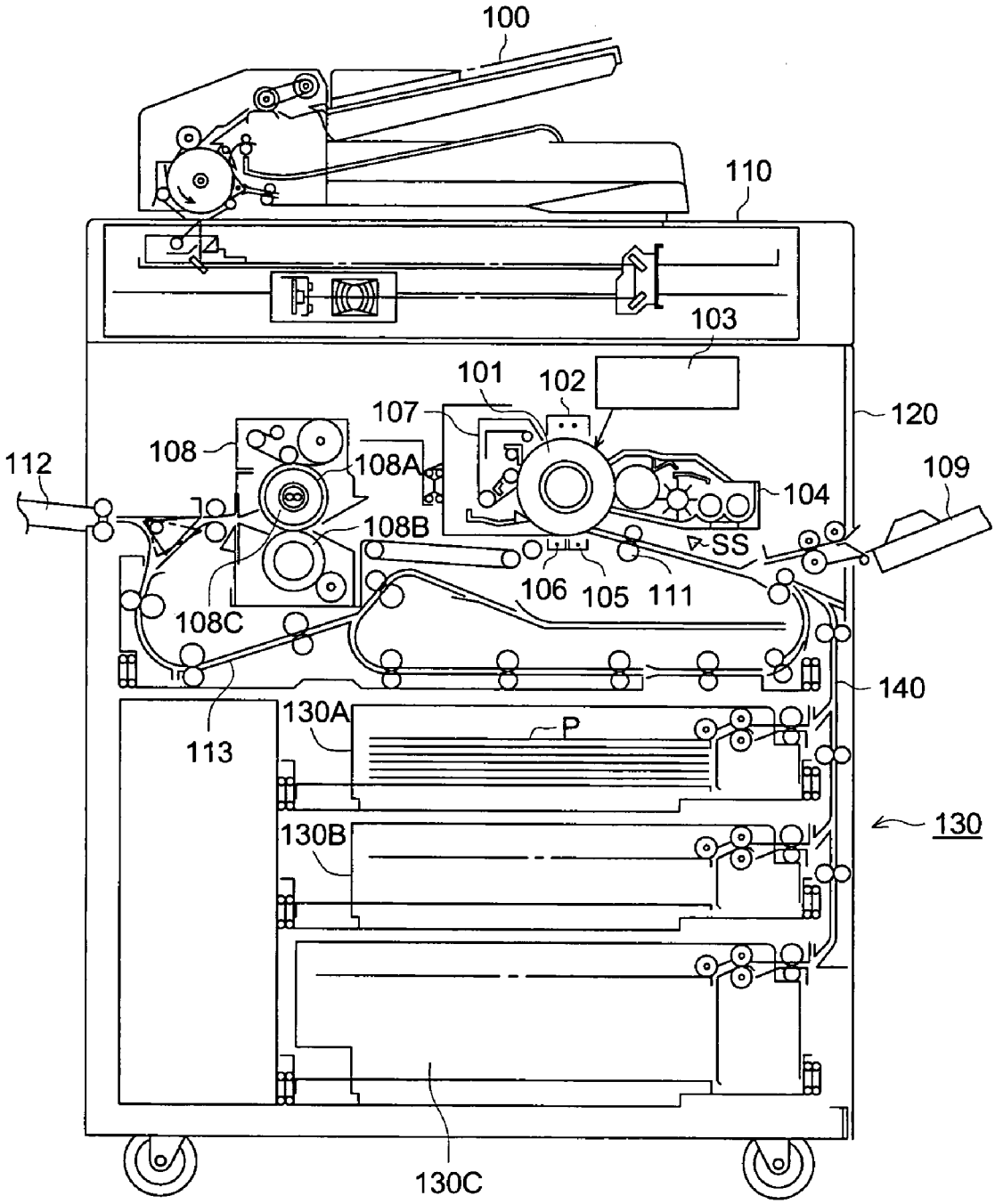
FIG. 3 shows the image forming apparatus relating to AN embodiment of the present invention.

FIG. 3 shows an example of the image forming apparatus relating to an embodiment of the present invention.

The image forming apparatus includes automatic document feeding device 100, document reading section 110, image forming section 120, fixing device 108 and sheet supplying section 130.

In FIG. 3, automatic document feeding device 100 feeds one by one documents stacked on a document stand to a reading position, and contains the read documents on a document receiving tray.

Document reading section 110 reads out images of the document, from which it generates digital image data.

Image forming section 120 forms the images on a recording material by an electro-photographic method. In image forming section 120, charging device 102, exposure device 103, developing device 104, transfer device 105, separating device 106 and cleaning device 107 are arranged around photoconductor drum 101 which is an image carrier. Plural sheet supplying sections are located under image forming section 120, and supplies recording material P to image forming section 120. Numeral 109 is a sheet supplying section for manual insertion. Recording material P, which is supplied from sheet supplying section 130 or manual sheet supplying section 109, is sent between photoconductor drum 101 and transfer section 105 by registration roller 111, after which recording material P is fixed by fixing device 108, and then ejected onto printed sheet storage tray 112.

Sheet supplying section 130 includes three sheet supplying trays 130A, 130B and 130C. Recording material P conveyed from sheet supplying section 130 is conveyed from sheet conveying section 140 to paired registration rollers 111.

While photoconductor drum 101 rotates clockwise, by the operations of charging device 10, exposure device 103, and developing device 104, the toner image is formed on photoconductor drum 101. The formed toner image is transferred onto recording material P by transfer device 105. Transfer material P carrying the transferred image is ejected to printed sheet storage tray 112.

In case of single surface image formation, after fixing, recording material P is directly ejected onto printed sheet storage tray 112, however, in case of double surface image formation, after recording material P on which the toner image of the front page has been transferred is fixed by fixing device 108, recording material P is conveyed into sheet re-feeding route 113. Recording material P is reversed in sheet re-feeding route 113, and then conveyed to paired registration rollers 111, after which recording material P is conveyed to the transfer section, where the toner image of the reverse page is transferred onto recording material P. Next, recording material on which the toner image of the reverse page has been transferred is fixed by fixing device 108, and ejected to printed sheet storage tray 112.

In addition, it is possible to apply the present invention to an image forming apparatus employing an intermediate transfer member.

Figure 4:
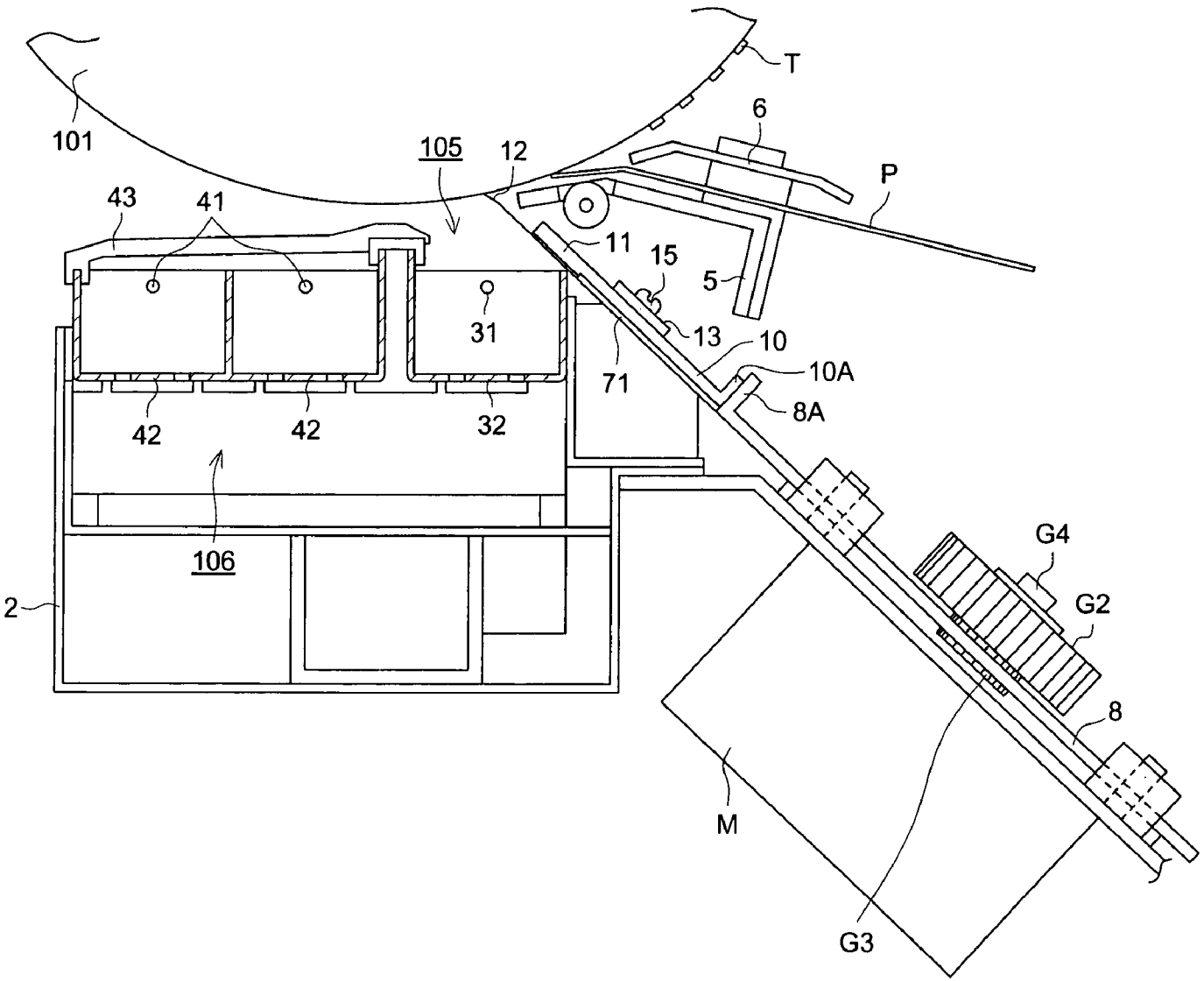
FIG. 4 shows the transfer device as well as a separating device.
Figure 5:
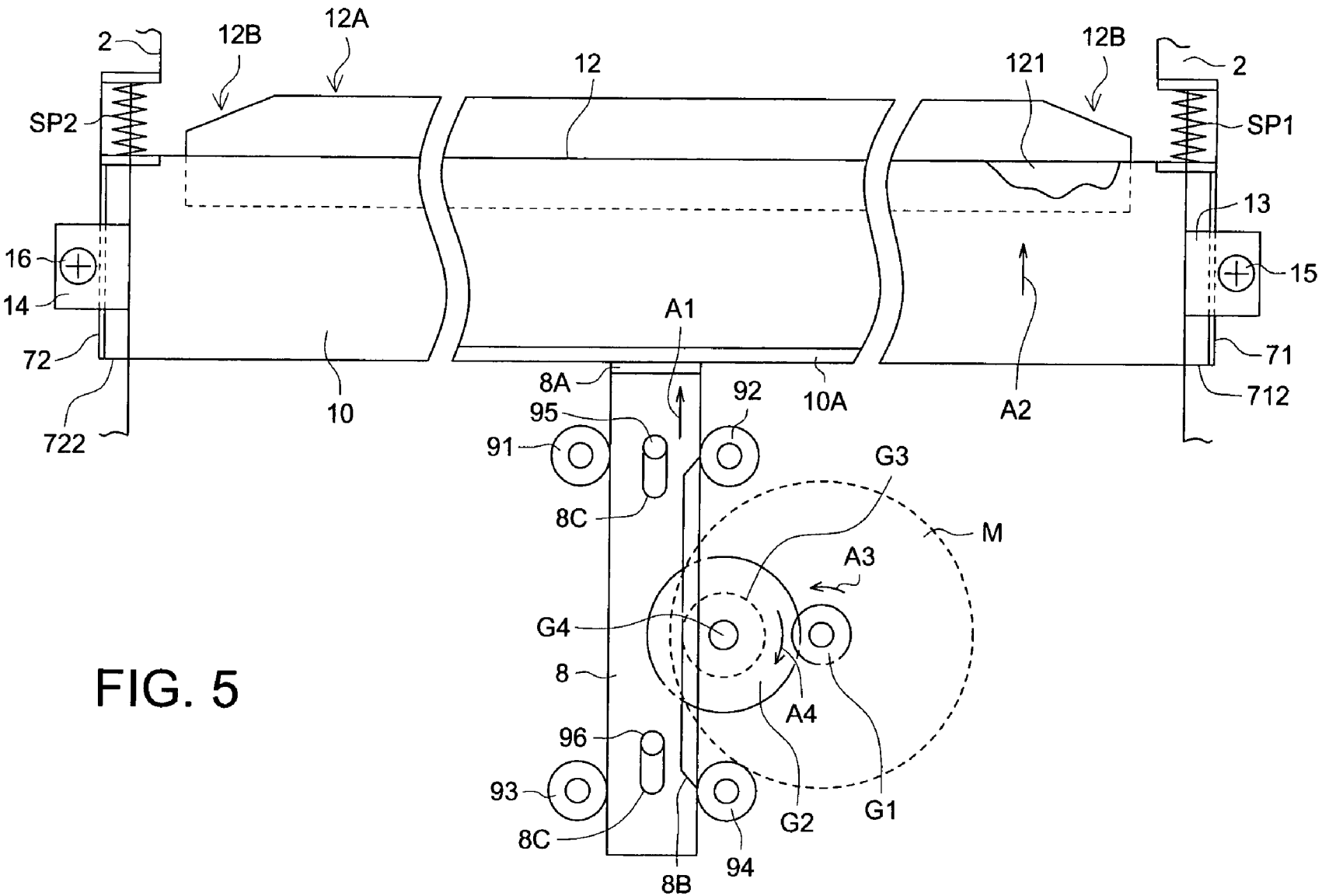
FIG. 5 is a side view watched from the upper right position in FIG. 4.

Transfer device 105 and the adjacent area will be now explained referring to FIGS. 4–6. FIG. 4 is a partial sectional schematic drawing of the front view of transfer device 105 and separating device 106, FIG. 5 is a side view watched from right upper side position in FIG. 4, and FIG. 6 shows the operation of the pressing means.

In FIG. 4, below photoconductor drum 101, transfer device 105 and separating device 106 are attached to frame 2. Transfer device 105 includes transfer electrode 31 and shielding plate 32. Separating device 106 includes two separating electrodes 41, shielding plates 42 corresponding to two separating electrodes 41, and guide member 43 for guiding the recording material.

Onto the opposite surface of recording material P, transfer electrode 31 provides via direct current corona discharge, the electrical charge at the opposite polarity of the polarity of toner image T on photoconductor drum 101, and thereby transfers the toner image from photoconductor drum 101 onto recording material P. Further, separating electrodes 41 discharge recording material P via alternate current corona discharge, so that recording material P is separated from photoconductor drum 101.

Recording material P is guided through the clearance between conveyance guide members 5 and 6 arranged one above the other, and then recording material P is brought into contact with photoconductor drum 101 from its front edge.

The pressing means for pressing recording material P onto photoconductor drum 101 includes elastic plate 12, the top of which presses recording material P onto photoconductor drum 101.

Elastic plate 12 is made of a PET (polyethylene terephthalate) film, the full width of which evenly presses recording material P onto photoconductor drum 101. Pressing by elastic plate 12 will be detailed later.

In FIG. 5, the end of elastic plate 12 is attached to supporting plate 10 by double-faced adhesive tape 121. Concave portions 71 and 72 are formed on frame 2 in order to retain both ends of supporting plate 10, and also to guide the movement of supporting plate 10. Both ends of supporting plate 10 are retained in concave portions 71 and 72, employing maintaining members 13 and 14 secured by screws 15 and 16. Both ends of supporting plate 10 are forced downward in FIG. 5 by compressed coiled springs SP1 and SP2, the lowest positions of which are determined by stoppers 712 and 722 located at the lower ends of concave portions 71 and 72. Supporting plate 10 is pushed at its lateral center by displacement plate 8 and driven in the direction indicated by arrow A2 in FIG. 5. Folded section 10A of supporting plate 10 is brought into contact with folded section 8A of displacement plate 8 so that the physical relationship of folded sections 10A and 8A are exactly determined. Rectangular displacement plate 8 is supported by four rollers 91–94 at two sides, and driven in the direction shown by arrow A1. Additionally, displacement plate 8 is guided by pins 95 and 96 secured to frame 2 and paired slots 8C.

Still further in FIG. 5, gear G1, fixed on the shaft of motor M, engages speed reduction gear G2. Pinion G3, coaxial and integral with speed reduction gear G2, engages rack 8B provided on displacement plate 8. Motor M rotates in arrow direction A3 and displacement plate 8 moves in arrow direction A1. Supporting plate 10 moves in arrow direction A2, opposing the force of coiled springs SP1 and SP2. Straight edge portion 12A of elastic plate 12 moves in arrow direction A2, and comes into contact with photoconductor drum 101.

FIG. 6(*a*) shows the pressing means in a standby condition, in which straight edge portion 12A of elastic plate 12 is separated from photoconductor 101, and FIG. 6(*b*) shows the operating condition of the pressing means, in which straight edge portion 12A presses recording material P onto photoconductor 101.

In FIG. 3, after a predetermined time has passed since sensor SS, located upstream of registration rollers 111, detects the top edge of recording material P, motor M feeds straight edge portion 12A to the pressing position of recording material P onto image carrier 101, shown in FIG. 6(*b*), that is, the top of recording material P comes into contact with image carrier 101. When the predetermined time has passed, that is, when the end of recording material P passes the image transfer position, motor M reverses. By the reverse rotation of motor M, elastic plate 12 is sent back to the standby position by the force of compression coiled springs SP1 and SP2, shown in FIG. 6(*a*).

The shape of elastic plate 12 will be explained referring to FIG. 7.

Figure 7:
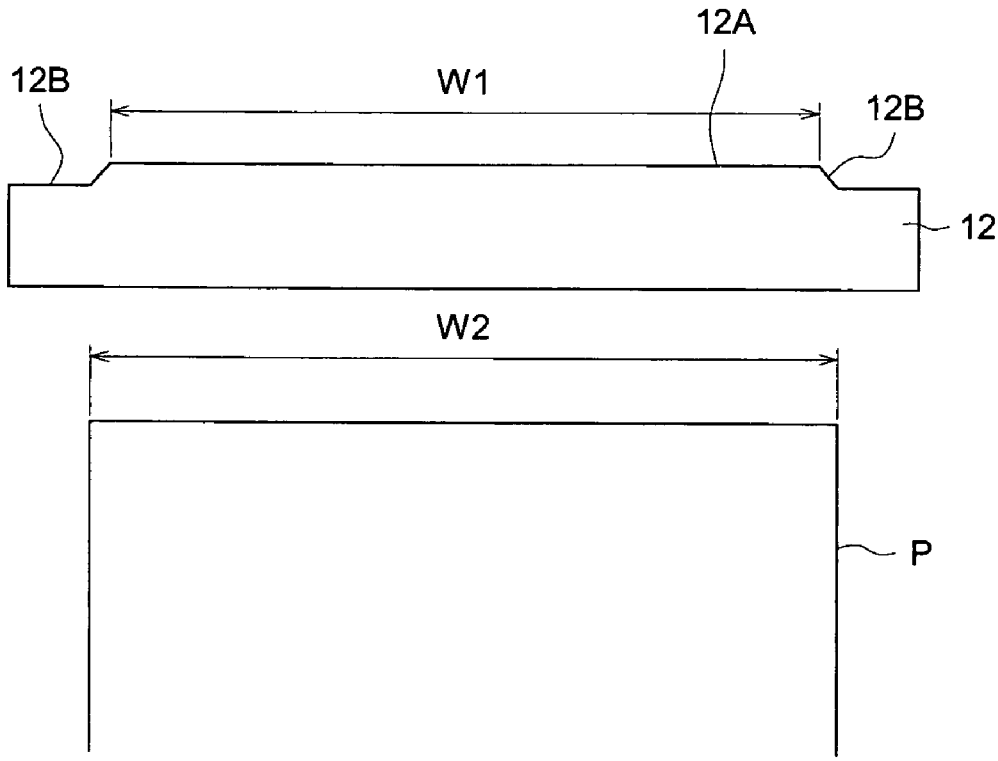
FIGS. 7(*a*) and (*b*) show the elastic plate.
Figure 7:
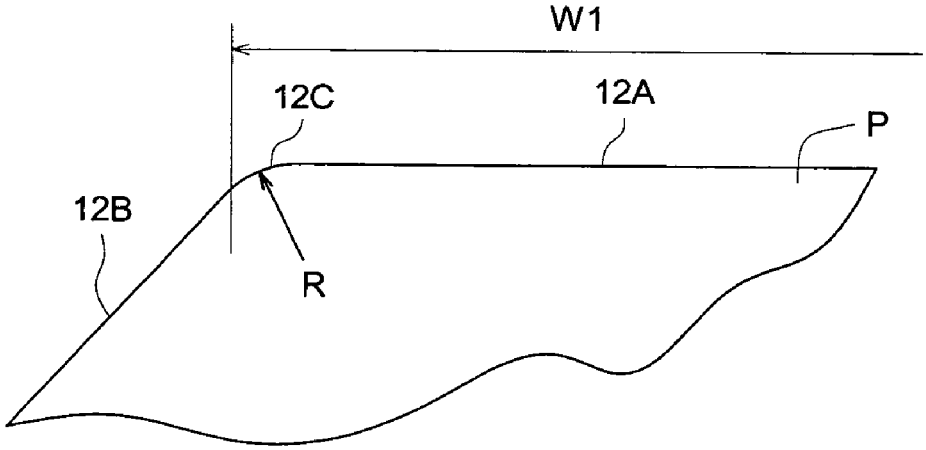

FIG. 7(*a*) is a total view of elastic plate 12. Straight edge portion 12A for pressing recording material P onto image carrier 101 is formed on the top of elastic plate 12, and sloped edge portions 12B are formed at both ends of straight edge portion 12A. Sloped edge portions 12B are declined from inside to outside of elastic plate 12. That is, the top portion of elastic plate 12 forms a trapezoid.

Since straight edge portion 12A presses recording material P, pressing width W1 of elastic plate 12 is the same width as straight edge portion 12A.

Symbol W2 is the width of recording material P. Since recording material P may move in the width direction during the conveyance, pressing width W1 is set at the center of width W2 of recording material P.

The pressing width W1 is prepared for each width of a leading edge of some kind of recording material's sizes. For example, the elastic plates is enable to exchange manually, or automatically.

Additionally, a plurality of the elastic plates having the straight edge portions matching to various widths of the transfer materials is prepared. For example, the elastic plate is assembled in the image forming apparatus so as to be manually changed by user or service person. On the other hands, it is also possible that the image forming apparatus automatically changes the elastic plates on the basis of an selected size of the recording material.

Table 1 shows the experimental results wherein two values are employed, being 297 mm (the width of A4 size sheet) and 279 mm (the width of 11-inch paper sheet) for width W2 of recording material P. Several values of pressing width W1 were used for the image transferring test.

TABLE 1

| Percentage of press (%) | Width of sheet: A4 size (297 mm) Pressing width (mm) | A4 size (297 mm) Non-pressing width (mm) | 11 inches (279 mm) Pressing width (mm) | 11 inches (279 mm) Non-pressing width (mm) | Result: Repelling at both end | Result: Transferring characteristic of black and even print |
|---|---|---|---|---|---|---|
| 98 | 291 | 3 | 273 | 3 | A *1 | A |
| 97 | 288 | 4 | 271 | 4 | A | A |
| 96 | 285 | 6 | 268 | 6 | A | A |
| 95 | 282 | 7 | 265 | 7 | A | A |
| 94 | 279 | 9 | 262 | 8 | B *2 | B |
| 93 | 276 | 10 | 259 | 10 | C *3 | C |
| 92 | 273 | 12 | 254 | 11 | C | C |
| 91 | 270 | 13 | 254 | 13 | C | C |
| 90 | 267 | 15 | 251 | 14 | C | C |
| 69 | 205 | 46 | 193 | 43 | C | D *4 |

Note:
*1: "A" means excellent transference of the image.
*2: "B" means wrong transference of the image.
*3: "C" means very wrong transference of the image.
*4: "D" means the worst transference of the image.

As understood by Table 1, when (W1/W2×100) is equal to or greater than 95, excellent transference of the image is obtained, however when (W1/W2×100) is less than 95, image repelling is generated at both edges of recording material P, and thereby transference of an even image is from poor to bad.

In this case, non-pressing width in Table 1 is the width of one of the non-pressing areas.

Further, it is understood by the experiment that when (W1/W2×100) is greater than 96, elastic plate 12 comes into contact with image carrier 101 with vibration of recording material P, which causes scratches on image carrier 101.

This experiment proves that sloped edge portions 12B are formed at both ends of elastic plate 12, and pressing width W1 is set to be equal to or greater than 95%, but equal to or less than 96% of width W2 of recording material P, resulting in excellent transference.

Further, in another experiment conducted by the inventor, curved intermediate portion 12C was formed between straight edge portion 12A and sloped edge portion 12B, and when curvature radius R of intermediate portion 12C was set to 5 mm, shown in FIG. 7(*b*), transferring fault, such as repelling at the edge of recording material P, was prevented. Specifically, prevented was uneven image density caused by uneven transference at the border between straight portion 12A and sloped edge portion 12B, resulting in even density image formation.

Additionally, electrostatic charging is concentrated at the contact point of straight edge portion 12A and sloped edge portion 12B, and toner repelling is likely to happen. Therefore intermediate section 12C, formed at the contact point, can control toner repelling. In this case, the pressing width of a pressing section includes straight edge portion 12A, sloped edge sections 12B and intermediate sections 12C.

In the process of double-surface image formation, which forms an image on the front and reverse surfaces of the recording material, the above pressing means for pressing the recording material onto the image carrier is most effective, specifically for the reverse surface image forming process of high quality and stable image formation.

Referring to FIG. 3, the double surface image formation will now be explained.

As explained above, after recording material P, on which the toner image of the front page has been transferred, is fixed by fixing device 108, recording material P is conveyed into sheet re-feeding route 113. Recording material P is reversed via sheet re-feeding route 113, and then conveyed to paired registration rollers 111, after which recording material P is conveyed to the transfer section, where the toner image on the reverse side is transferred onto recording material P.

Next, recording material on which the toner image of the reverse page has been transferred is fixed via fixing device 108, and ejected onto printed sheet storage tray 112. The fixing device includes heating roller 108A incorporating heat source 108C, and pressure applying roller 108B. The fixing process is performed while recording material P is nipped between heating roller 108A and pressure applying roller 108B. During the fixing process, heat and pressure are applied to recording material P.

When the toner images are transferred onto the reverse surface of recording material P, recording material P has a high electric resistance as well as a slightly uneven surface. This is due to moisture in recording material P having been evaporated by heat and pressure, during the process of front surface image formation.

Due to this, when the images are transferred onto the reverse surface, clearance is generated between the surface of recording material P and photoconductor 101, resulting in wrong transference.

In the present embodiment, recording material P is pressed onto photoconductor 101 by the pressing means so that recording material P contacts the surface of photoconductor 101, whereby, the present embodiment performs excellent transference of images.

Accordingly, for the front surface image formation of single surface image formation, as well as double surface image formation, the pressing means can be set to the standby position shown in FIG. 6(*a*), however for the reverse surface image formation, the pressing means is set at the position shown in FIG. 6(*b*) and the image is transferred.

Employing these Structures, prevented are uneven transferred image portions which may be caused when the pressing means is employed for transferring, and thereby high quality images are produced. Further prevented is the deterioration of durability of the image carrier which would be adversely affected by the contact of the edges of the pressing material.

Furthermore, prevented is variation of image density caused by the boundary sections between the straight edge portion and the sloped portions formed on the elastic material of the pressing means, and thereby images of even density can be produced.

What is claimed is:

1. An image forming apparatus, comprising:

an image carrier;

a transfer device for charging a back surface of a recording material in contact with the image carrier, and transferring toner images carried on the image carrier onto the recording material; and a pressing section for pressing the transfer material onto the image carrier by pushing the back surface of the transfer material;

wherein the pressing section includes an elastic plate whose top portion is formed to be a trapezoidal shape, including:

a straight edge portion positioned at the center of the pressing section, perpendicular to the feeding direction of the recording material, and sloped edge portions at both ends of the straight edge portion, wherein the width of the straight edge portion is equal to or greater than 95% of the width of the recording material.

2. The image forming apparatus described in claim 1, wherein the pressing section further includes an intermediate section, the top of which is curved at curvature radius of 5 mm or more, formed between the straight edge portion and the sloped edge portion.

3. The image forming apparatus described in claim 1, wherein the elastic plate is made of a polyethylene terephthalate film.

4. An image forming apparatus comprising:

an image carrier;

a transfer device for charging a back surface of a recording material in contact with the image carrier, and transferring toner images carried on the image carrier onto the recording material; and a pressing section for pressing the transfer material onto the image carrier by pushing the back surface of the transfer material;

wherein the pressing section includes an elastic plate whose top portion is formed to be a trapezoidal shape, including:

a straight edge portion positioned at the center of the pressing section, perpendicular to the feeding direction of the recording material;

sloped edge portions at both ends of the straight edge portion; and intermediate portions between the sloped edge portions and the straight edge;

wherein the intermediate portion is curved at curvature radius of 5 mm or more.

5. The image forming apparatus described in claim 1, further comprising a position changing means for changing the position of pressing means from a pressing position to a standby position.

6. The image forming apparatus described in claim 1, wherein the width of the straight edge portion is equal to or less than 96% of the width of the recording material.

* * * * *